United States Patent [19]

Di Manno

[11] 4,339,138

[45] Jul. 13, 1982

[54] THROWING DEVICE

[76] Inventor: Carl M. Di Manno, P.O. Box 2111, Duxbury, Mass. 02332

[21] Appl. No.: 142,267

[22] Filed: Apr. 21, 1980

[51] Int. Cl.[3] ..... A63B 65/00

[52] U.S. Cl. ..... 273/428; D21/203

[58] Field of Search ..... 273/428, 65 EE, 65 EG, 273/65 EC, 425; 46/74 R, 74 A, 74 B, 74 C; D21/82, 203, 204

[56] References Cited

U.S. PATENT DOCUMENTS

| | | | |
|---|---|---|---|
| 2,093,737 | 9/1937 | Reach | 273/65 EG X |
| 2,906,533 | 9/1959 | Gow et al. | 273/65 EG |
| 2,931,653 | 4/1960 | Gow et al. | 273/65 EG |
| 3,884,466 | 5/1975 | MacDonald et al. | 273/65 EE X |
| 4,003,574 | 1/1977 | MacDonald et al. | 273/425 X |

*Primary Examiner*—Paul E. Shapiro

[57] ABSTRACT

A throwing and catching device of hand-fitting external proportions, composed of two truncated cones, placed small end to small end, to define a common throat. The diameters of the outer edges of the common throat being greater that its smallest diameter at the center. To the mid-section of the cones' exterior is attached a grip of various configuration. The configuration is such that the grip is substantially in the neutral area of the aero-slipstream created by the tips of both ends of the cones. The gripping surface is made-up jointly of the cones' exposed protruding ends and said grip. Said configuration forming a V-shaped trough on either side of the device's middle.

13 Claims, 15 Drawing Figures

THROWING DEVICE

BACKGROUND OF THE INVENTION

The present invention relates to throwing devices of the class generally exemplified in U.S. Pat. Nos. 2,683,603, 3,264,776 and 4,151,674 and other patents cited therein.

It is an important object of the invention to provide a superior device of such class with high aerodynamic stability controllably flyable and catchable over long throw distances which corrects erratic or wobbling flight.

It is a further object of the invention to provide aesthetically interesting appearance consistent with the preceding object.

It is a further object of the invention to provide a simple and economically manufacturable device consistent with one or more of the preceding objects.

It is a further object of the invention to provide a natural feeling and easily usable throwing and catching device consistent with one or more of the preceding objects.

SUMMARY OF THE INVENTION

The objects of the invention are fulfilled by a throwing and catching device conprising end to end frustoconical sections with the small ends in toward each other to define a common throat. The throat is partially surrounded by gripping means, the gripping means being formed by both the attached grip and the underlying protruding cone end forming a V-surface, which are surfaced or geometrically arranged, substantially within the imaginary cylinder created by the device's outer edge diameters, to provide a surface portion for some grip by some fingers of the thrower's hand to impart propulsion and provide another portion to provide axial rotation as the device is thrown. The throw with spin of a device with a leading inner face of only conical form with a trailing reversed conical form and recessed grip provides a self-correcting aerodynamic condition utilizing relative air flow to provide stabilizing force.

These and other objects, features and advantages of the invention will be apparent from the following detailed description with reference therein to the accompanying drawing in which:

BRIEF DESCRIPTION OF PREFERRED EMBODIMENTS

DETAILED DESCRIPTION OF PREFERRED EMBODIMENTS

Figure 1:
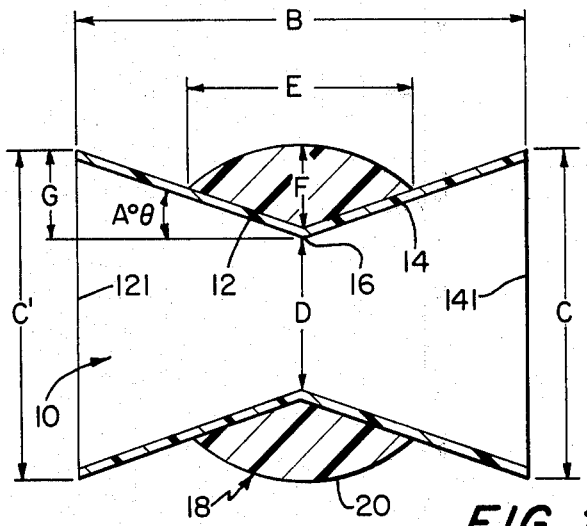
FIG. 1 is a cross-section sketch of a preferred embodiment of the invention showing critical dimension (ranges)

Referring now to FIG. 1, there is shown a preferred embodiment of the throwing device 10 of the invention comprising a pair of frusto conical tubes 12 and 14 defining a common throat 16. The throat 16 is surrounded by an annular or substantially annular gripping base 18 which has an appropriate gripping surface 20 [several variations of which are shown in FIGS. 2–5 below]. Dimensions A–G of the device 10 can fall within the practical limits of column I of the following table, but preferably fall within those of column II for greater effectiveness consistent with the preceding objects.

| | I | II |
|---|---|---|
| A | 5°–45° | 12°–14° |
| B | 2"–12" | 6½" |
| C | 2"–12" | 4¼" |
| D | 1"–10" | 3.5" |
| E | .5"–9" | 3" |
| F | .5"–3" | .75"–1" |
| G | .25"–6" | .75"–1" |

Figure 1A:
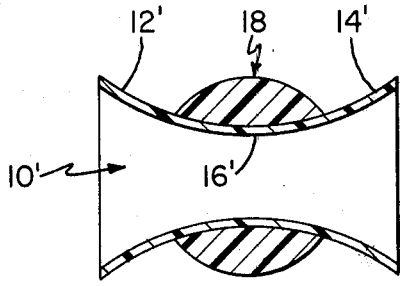
FIGS. 1A, 1B and 1C are other embodiments with substantial variation in a central tube component thereof.
Figure 1B:
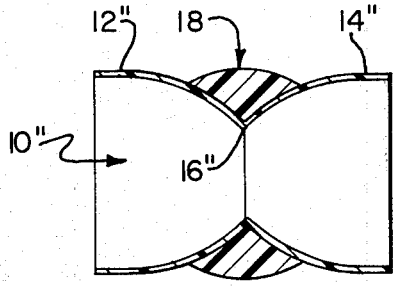
Figure 1C:
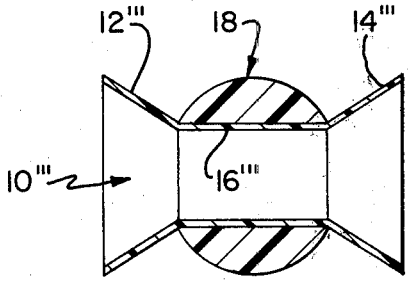

FIGS. 1A, 1B and 1C show other embodiments thereof of devices 10', 10'' and 10'''. In the device 10' of FIG. 1A inwardly convex flares are provided on symmetrical tubular portions 12' and 14', with a central neck 16' formed therebetween. Device 10'' of FIG. 1B comprises concave inwardly sections 12'' and 14'' and a resultant neck 16''. Device 10''' of FIG. 1B comprises an elongated central neck 16''' with shorter cones 12''' and 14''' (straight form as in FIG. 1, but which could be, alternatively, flared as in either of FIGS. 1A or 1B).

Figure 2:
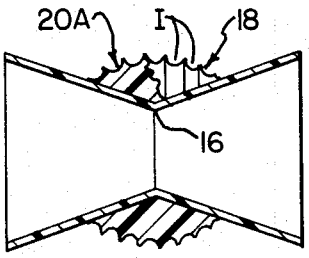
FIGS. 2–6 and 9 are similar views of other embodiments with substantial variation in grip portions thereof, usable in substantially all permutations with the various embodiments of FIGS. 1–1C and 10–12 illustrating a variety of usable surface forms; and cone configurations.
Figure 3:
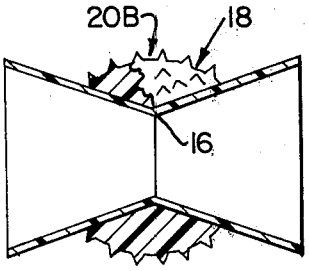
Figure 4:
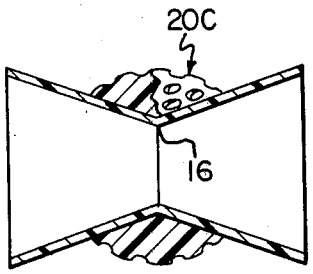

FIG. 2 shows an optimum gripping surface 20A comprising finger width indentations I. FIG. 3 shows a grip surface 20B comprised of random protrusions and FIG. 4 shows one comprised of random holes linearly and/or annularly arranged or regularly arranged in a line or lines.

Figure 5:
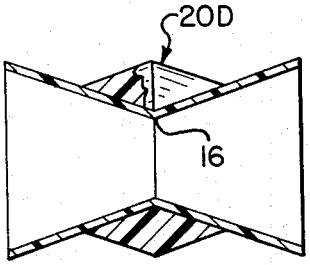
Figure 6:
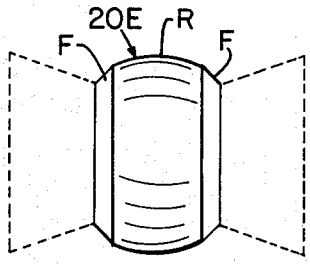

FIG. 5 shows a conical cross section gripping annulus 18 (with a vertex V having an included angle of 80°–120°) and faces 20D1 and 20D2 to form a surface 20D which grips well because of geometry. FIG. 5 graphically deplicts the V-shaped troughs or valleys which comprise the gripping surfaces. FIG. 5 is configured such that a thrower's hand can place all fingers in one trough or some fingers in one and some fingers in the other. The effect is the ability of the thrower's hand to embrace the device precisely and surely, in a relationship or relative position that is excellent for manipulating and throwing the device. Similarly FIG. 6 provides a grip 20E based on rounded section R and flat faces F. The round has a barrel form. The thrower parts the index and middle fingers on R and the two smaller fingers on a flat F with the thumb some 180° opposite.

In all of these embodiments, the thrower can have a surface element of the grip for propulsion (push) and another surface area for reliably imparting spin to the device as it is thrown. The throwing motion is a football throwing motion.

Figure 7:
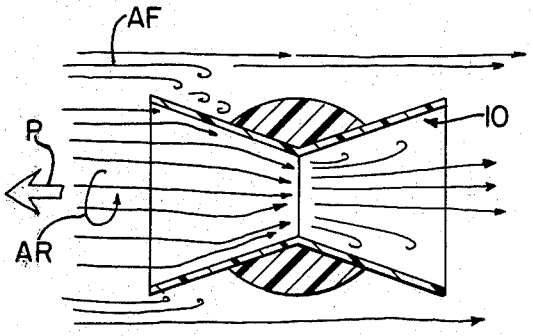
FIGS. 7 and 8 are cross section sketches similar to FIG. 1 indicating in-flight conditions.
Figure 8:
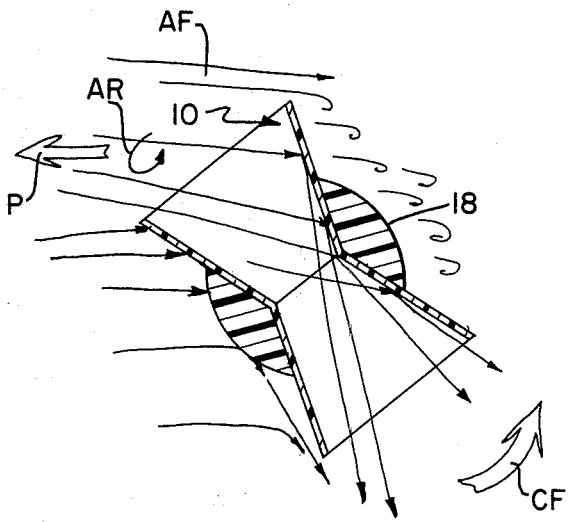
Figure 10:
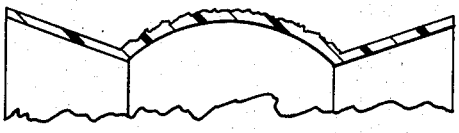
Figure 11:
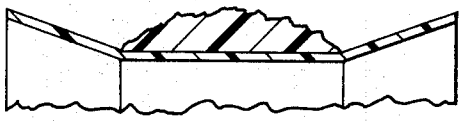
Figure 12:
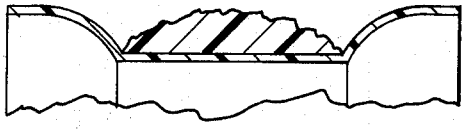

The self-corrective action of the device is illustrated in FIGS. 7–8, FIG. 7 indicating straight flight in direction P with axial rotation AR and FIG. 8 indicating the self-correcting force CF to right a wobble situation. Relative airflow is indicated by arrows AF. Not only will the wobble subside, but the device will orient straight into the direction it is traveling when thrown. This feature is due to the device's designed in unique course of least resistance and its ability to orient to it. Both direct wind pressure and vacuum creation at various points inside and outside the device as illustrated in the FIGS. 7 and 8 are utilized as motivating forces to correct a wobble and maintain a straight flight.

Figure 9:
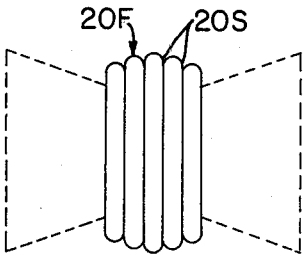

FIG. 9 shows another surfacing arrangement 20F made up of annular domes with the seams 20S thereof simulating the action of finger grooves (compare FIG. 2).

It is evident that those skilled in the art, once given the benefit of the foregoing disclosure, may now make numerous other uses and modification of, and departures from the specific embodiments described herein without departing from the inventive concepts. Consequently, the invention is to be construed as embracing each and every novel feature and novel combination of features present in, or possessed by, the apparatus and techniques herein disclosed and limited solely by the scope and spirit of the appended claims.

What is claimed is:

1. A throwing device of hand-fitting external proportions comprising a tubular core comprising two hollow substantially frusto conical members placed small end to small end to define a common throat at the central portion of the device, said central portion being substantially surrounded by gripping means comprising a grip which covers part but not all of the exterior surface of the tubular core, leaving a portion of larger end of each member protruding exposed at each end of the device, said grip lying substantially within the imaginary surface contained by the larger ends of the two members and defining with the exposed protruding ends of the tubular core a trough or valley between each end and the central portion of the tubular member.

2. The device of claim 1 wherein the frusto-conical portions of the device core are substantially symmetrical in form.

3. The device of claim 1 wherein the frusto-conical portions are straight cone sections.

4. The device of claim 1 wherein the frusto-conical portions are inwardly convex cone sections.

5. The device of claim 1 wherein the frusto-conical portions are inwardly concave cone sections.

6. A device according to claim 1 further comprising means defining positive gripping elements on the outer surface of said grip.

7. The device in accordance with claim 6 wherein said positive gripping means comprise troughs of annular form arranged perpendicular to the length dimension of the device as a whole.

8. The device in accordance with claim 6 wherein said positive gripping means comprise distinct point protrusions on said grip.

9. The device in accordance with claim 6 wherein said positive gripping means comprise holes in a substantial array in said grip.

10. The device in accordance with claim 1 wherein said gripping means are substantially rounded.

11. The device in accordance with claim 1 wherein flat ramps are provided on the gripping means.

12. The device in accordance with claim 1 wherein the dimensions A–G thereof (ref: FIG. 1) are within the ranges:

| | |
|---|---|
| A | 5°–45° |
| B | 2"–12" |
| C | 2"–12" |
| D | 1"–10" |
| E | .5"–9" |
| F | .5"–3" |
| G | .25"–6" |

13. The device in accordance with claim 12 wherein said dimensions are within the ranges:

| | |
|---|---|
| A | 12°–14° |
| B | 6½" |
| C | 4¼" |
| D | 3.5" |
| E | 3" |
| F | ¾" |
| G | .75"–1" |

* * * * *